US005941098A

United States Patent [19]

Guillard et al.

[11] Patent Number: 5,941,098

[45] Date of Patent: Aug. 24, 1999

[54] METHOD AND PLANT FOR SUPPLYING A VARIABLE FLOW RATE OF A GAS FROM AIR

[75] Inventors: Alain Guillard, Paris; Patrick Le Bot, Poissy, both of France

[73] Assignee: L'Air Liquide, Societe Anonyme Pour L'Etude et L'Exploitation des Procedes Georges Claude, Paris Cedex, France

[21] Appl. No.: 08/990,085

[22] Filed: Dec. 12, 1997

[30] Foreign Application Priority Data

Dec. 12, 1996 [FR] France ..... 96 150281

[51] Int. Cl.[6] ..... F25J 1/00

[52] U.S. Cl. ..... 62/656; 364/501

[58] Field of Search ..... 62/656; 364/501

[56] References Cited

U.S. PATENT DOCUMENTS

| | | | |
|---|---|---|---|
| 4,853,015 | 8/1989 | Yoshino | 62/656 |
| 5,084,081 | 1/1992 | Rohde | 62/656 |
| 5,209,070 | 5/1993 | Darredeau | 62/656 |
| 5,224,336 | 7/1993 | Agrawal et al. | 62/656 |
| 5,355,680 | 10/1994 | Darredeau et al. | 62/656 |
| 5,505,051 | 4/1996 | Darredeau | 62/656 |

FOREIGN PATENT DOCUMENTS

| | | |
|---|---|---|
| 0 250 390 | 12/1987 | European Pat. Off. . |
| 0 628 778 | 12/1994 | European Pat. Off. . |
| 1172934 | 12/1969 | United Kingdom . |

*Primary Examiner*—Ronald Capossela
*Attorney, Agent, or Firm*—Young & Thompson

[57] ABSTRACT

Up to a certain value (D1) of the demanded flow rate (D), this flow rate is brought to the working pressure and is sent to the consumer pipe. When the demanded flow rate is less than the value (D1), the complement to (D1) is brought to a high pressure, greater than the working pressure, and is sent into a buffer tank. Above the value (D1), the flow rate is supplemented by a flow rate which is drawn from the buffer tank and expanded to the working pressure. The method is useful in supplying oxygen to steel works with electric arc furnaces or to copper refineries.

17 Claims, 5 Drawing Sheets

AIR
41
50
38
40
39
OC
15
49

AIR
1
2
W
NC
6
7
8
9
10
15
39
40
38
50
49
OC
47
48

(a)
(b)
(c)
(d)
D
d1
d2
d3
t
0
T
t1 t2 t3 t4 t5
D3
D2
D1=DN
D4
D1
D3-D1
D2-D1

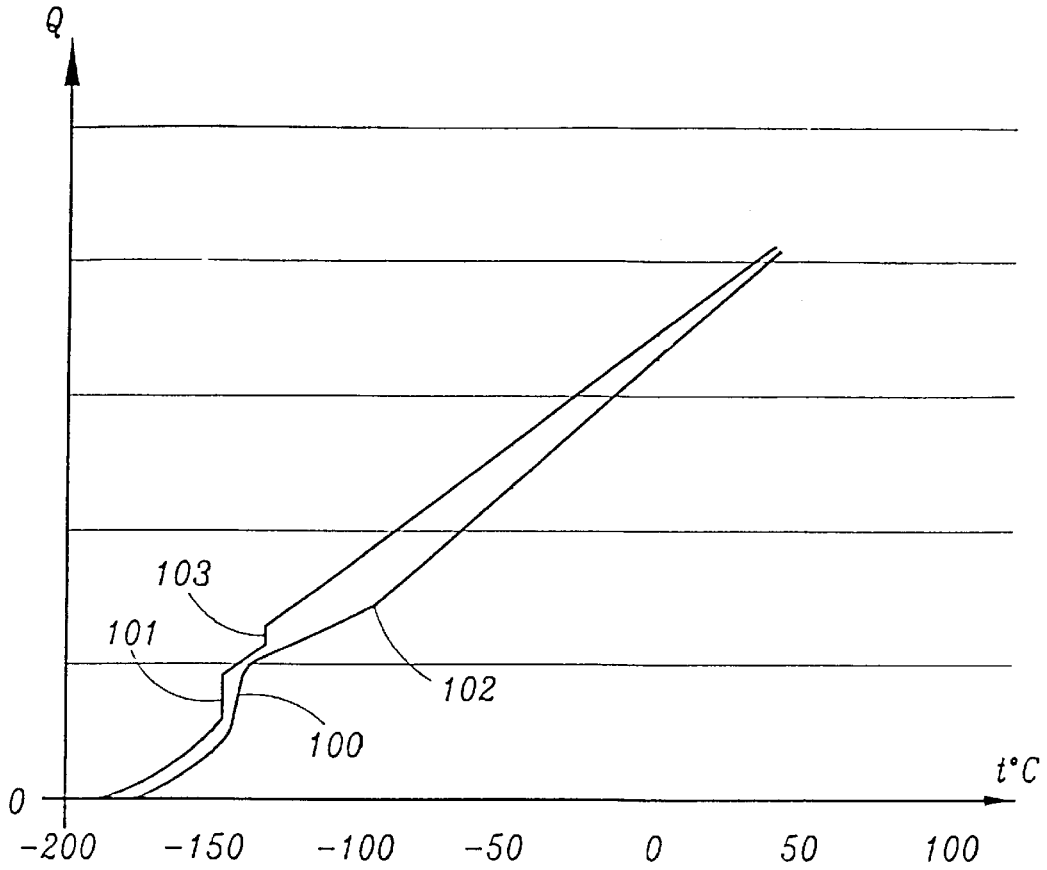
FIG. 4
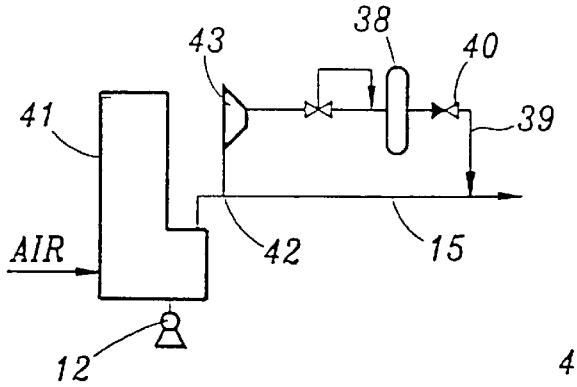
FIG. 5
FIG. 6
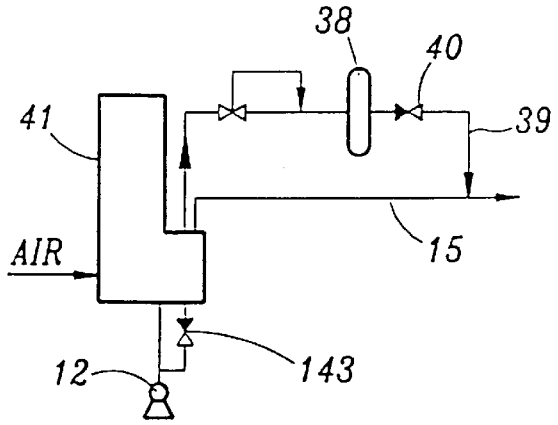

METHOD AND PLANT FOR SUPPLYING A VARIABLE FLOW RATE OF A GAS FROM AIR

FIELD OF THE INVENTION

The present invention relates to a method for supplying a consumer pipe for a time interval with a variable demanded flow rate of a constituent of air, in particular oxygen, produced by an air distillation apparatus. It applies in particular to the provision of oxygen under pressure at a variable flow rate.

The pressures referred to here are absolute pressures, and the flow rates are molar flow rates.

BACKGROUND OF THE INVENTION

In certain industrial activities, such as when using electric arc furnaces in the steel industry, or when refining copper, oxygen is used in batch mode, with significant variations in flow rate and at moderately high pressures (of the order of a few bars to about twenty bars). Various solutions are conventionally used to accommodate these changes in flow rate.

For example, EP-A-0,422,974 in the name of the Assignee describes a "seesaw" method intended for the production of oxygen gas at variable flow rate. The demanded oxygen is drawn from a reservoir, brought to the working pressure by pumping, and vaporized by condensation of a variable flow rate of air to be distilled.

In this known method, it is easy to show that, in order to keep the supply and withdrawal flow rates of the distillation and apparatus constant, it is necessary to vary the entering air flow rate in the same direction as the variations in the oxygen consumption. In the case when oxygen is produced under pressure, the air which is condensed in order to vaporize the liquid oxygen is boosted by an additional booster and, when the oxygen demand varies, both the boosted flow rate and the flow rate compressed by the main compressor need to be varied significantly.

In consequence, in this known method, the compressor and, where appropriate, the booster are overengineered significantly in comparison with the nominal oxygen flow rate to be produced. They also operate for most of the time at flow rates which are very different from their nominal flow rate, and therefore with impaired efficiency. To this is added the fact that the continuous presence of a reserve of the two liquids is needed in order for the seesaw to operate properly.

It has also been proposed for the gas to be produced to be stored in the form of gas in an auxiliary tank or "buffer", at a pressure greater than the production pressure. However, this solution is not satisfactory because it requires very large buffers to be installed in order to cater for very long-term consumption peaks. Furthermore, producing all of the gas at the pressure of the buffer is expensive in terms of energy.

SUMMARY OF THE INVENTION

The object of the invention is to make it possible to supply gas from air at variable flow rate under particularly efficient and economical conditions.

For this purpose, the invention relates to a method for supplying a consumer pipe for a time interval with a variable demanded flow rate of a constituent of air, in particular oxygen, produced by an air distillation apparatus, characterized in that:

- a total flow rate of the constituent with constant value is drawn from the apparatus;

- the time interval is divided into several types of periods, namely:
  - if appropriate, at least a first period during which the demanded flow rate is equal to the total flow rate;
  - at least one second period during which the demanded flow rate is less than the total flow rate; and
  - at least one third period during which the demanded flow rate is greater than the total flow rate;
- during the first period or periods, the total flow rate is brought to the working pressure and is sent to the consumer pipe;
- during the second period or periods:
  - the demanded flow rate is brought to the working pressure and is sent to the consumer pipe; and
  - a storage flow rate of the constituent, equal to the difference between the total flow rate and the demanded flow rate is brought to a high pressure greater than the working pressure, and this storage flow rate is stored in at least one buffer tank; and
- during the third period or periods:
  - the total flow rate is brought to the working pressure and is sent to the consumer pipe, and
  - a supplementary flow rate of the constituent, equal to the difference between the demanded flow rate and the total flow rate is also sent into the consumer pipe, this supplementary flow rate being drawn from at least one buffer tank and expanded to the working pressure.

The method according to the invention may include one or more of the following characteristics:

- the total flow rate is drawn in liquid form from the distillation apparatus and is compressed in this form by pumping before being vaporized;
- a first liquid flow rate is brought to the working pressure by means of a first pump, the flow rate intended for the buffer tank is brought to the high pressure by means of a second pump, and each liquid flow is vaporized under its pumping pressure;
- the total flow rate is brought to the working pressure by means of a single pump, this liquid is vaporized and the fraction of the gas thus obtained, intended for the buffer tank is brought to the high pressure;
- the total flow rate is brought to the high pressure by means of a single pump, a fraction of this total flow rate is expanded to the working pressure and the two flows are each vaporized under its pressure;
- a first flow rate is drawn in liquid form from the distillation apparatus, is compressed by pumping and is vaporized under this pressure; and the remainder of the total flow rate is drawn in the form of gas from the distillation apparatus and is compressed in this form;
- the total flow rate is drawn in the form of gas from the distillation apparatus, a fraction of this gas is compressed to the working pressure, and the supplementary flow rate intended for the buffer tank is compressed to the high pressure;
- each flow rate is compressed independently from the withdrawal pressure of the distillation apparatus;
- the total flow rate is compressed to the working pressure and a fraction of this first flow rate is compressed from the working pressure to the high pressure.

The invention also relates to an air distillation plant intended to implement the method described above. According to the invention, this plant comprises means for drawing a constant flow rate of the constituent from the distillation apparatus; a buffer tank; first means for bringing at least a part of the total flow rate to the working pressure and in the form of gas, these first means being connected to the consumer pipe; second means for bringing a second flow rate of the constituent to a high pressure greater than the working pressure and in the form of gas, these second means being connected to the buffer tank; and an auxiliary pipe fitted with a controlled pressure-reducer valve, connecting the buffer tank to the consumer pipe.

According to various optional characteristics of this plant:

- the first means comprise a first pump and first vaporization means, and the second means comprise a second pump and second vaporization means;
- the first means comprise a pump and vaporization means, and the second means comprise a compressor whose intake is connected to the outlet of the vaporization means;
- the first means comprise a pump, a pressure-reducer valve and first vaporization means, and the second means comprise a second vaporization means connected to the delivery of the pump;
- the first means comprise a compressor whose intake is connected to a gas withdrawal point of the distillation apparatus, and the second means comprise a pump and vaporization means connected to the delivery of this pump;
- the first and second means respectively comprise two compressors whose intakes are connected in parallel to a withdrawal point of the distillation apparatus;
- the first means comprise a first compressor whose intake is connected to a gas withdrawal point of the distillation apparatus, and the second means comprise a second compressor whose intake is connected to the delivery of the first compressor.

BRIEF DESCRIPTION OF THE DRAWINGS

Illustrative embodiments of the invention will now be described with reference to the appended drawings, in which:

FIG. 4 is a heat-exchange diagram corresponding to this plant, with the temperatures (in ° C.) on the abscissa and the quantities of heat which are exchanged on the ordinate;

FIGS. 5 and 6 are views which are similar to FIG. 2 and respectively relate to two variants of the plant;

DESCRIPTION OF THE PREFERRED EMBODIMENTS

Figure 1:
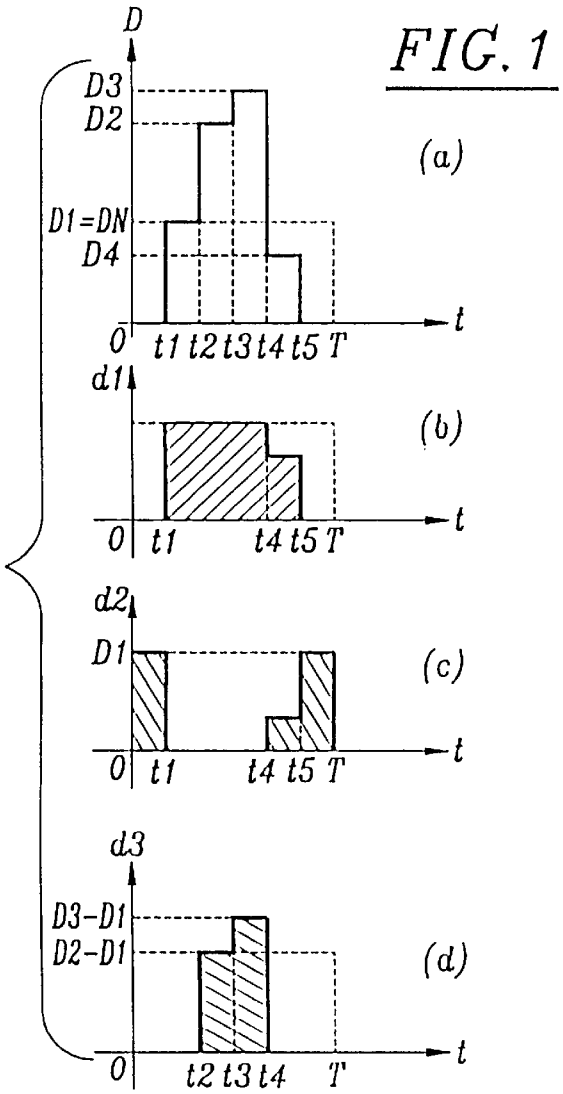
FIG. 1 illustrates the method of the invention by means of four diagrams (a) to (d)

FIG. 1(*a*) illustrates a simplified curve of demand for oxygen under a working pressure P, during a time period extending from a time t=0 to a time T. It will be assumed below that the pressure P is constant and equal to 16 bar, but it will be understood that this pressure P may also fluctuate about an average value.

The variable oxygen demand is, for example, that of a steel works using electric arc furnaces and includes six successive time intervals:

from t=0 to t1, the demanded flow rate is zero;

from t1 to t2 the demanded flow rate is D1;

from t2 to t3 the demanded flow rate is D2>D1;

from t3 to t4, the demanded flow rate is D3>D2;

from t4 to t5, the demanded flow rate is D4<D1;

from t5 to T, the demanded flow rate is zero.

Furthermore, DN indicates the nominal flow rate of the oxygen production plant. This flow rate DN is equal to D1 in this example, but as a variant it could be greater than this value, if the plant is intended to supply oxygen to other consumers as well.

FIG. 1(*b*) represents the production dl of oxygen at 16 bar by the plant. This production varies as follows:

from t=0 to t1: d1=0 from t1 to t4, that is to say when the oxygen demand is greater than or equal to D1: d1=D1;

from t4 to t5, that is to say when the oxygen demand is greater than 0 but less than D1: d1=D4;

from t5 to T: d1=0.

FIG. 1(*c*) represents the production d2 of oxygen at a high pressure P1 which is markedly greater than 16 bar, typically of the order of 30 bar:

from t=0 to t1: d2=D1;

from t1 to t4: d2=0;

from t4 to t5: d2=D1−D4;

from t5 to T: d2=D1.

It can therefore be seen that, throughout the period 0, T, it is always true that d1+d2=D1, a constant flow rate considered as the "total" oxygen flow rate, with regard to the use in question.

The flow rate d1 is sent directly to the user or consumer pipe, while the flow rate d2 is sent to a buffer tank. When the demanded flow rate D is greater than D1, that is to say from t2 to t4, the complement d3=D−D1 is drawn from the buffer tank, expanded to the working pressure and introduced into the consumer pipe. This flow rate d3 is represented by diagram (d).

The oxygen demand is thus supplied:

from t1 to t2 and from t4 to t5, only by the production of oxygen at 16 bar, and from t2 to t4, partially by this production at 16 bar and partially by oxygen drawn from the buffer tank then expanded.

FIGS. 2, 3 and 5 to 11 represent several different plants capable of implementing a method of this type.

Figure 3:
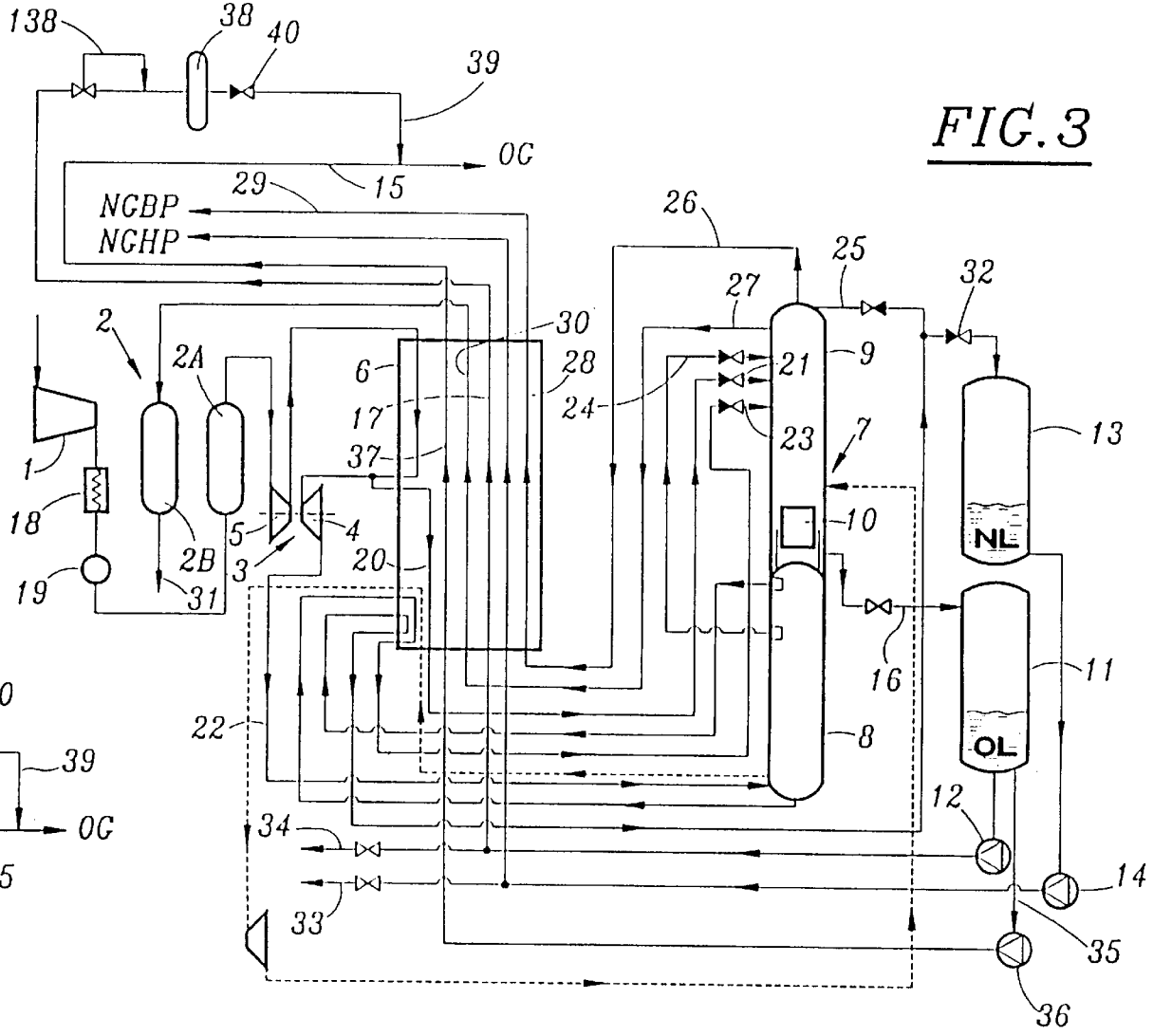
FIG. 3 represents the same plant in more detail.
Figure 2:
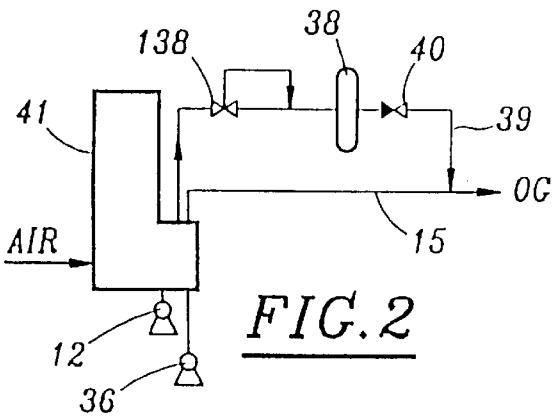
FIG. 2 very schematically represents a plant according to the invention.

FIGS. 2 and 3 relate to a plant similar to the one represented in FIG. 1 of U.S. Pat. No. 5,329,776 and differs therefrom only by the incorporation of an additional line 35 for drawing off liquid oxygen, an additional pump 36 designed to bring this liquid oxygen to the aforementioned pressure P, additional passages 37 in the heat-exchange line, for vaporizing and heating this oxygen to close to ambient temperature, a buffer 38 for storing high-pressure oxygen originating from the circuit consisting of the pump 12 and passages 17, a pressure controller 138 arranged upstream of this buffer, and a line 39 fitted with a pressure-reducer valve 40, connecting this buffer to the consumer pipe 15.

Thus, as described in the aforementioned U.S. Pat. No. 5,329,776, the air distillation plant represented in FIG. 3 essentially comprises: an air compressor 1; an apparatus 2 for purifying compressed air with respect to water and with respect to $CO_2$ by adsorption, this apparatus comprising two adsorption bottles 2A, 2B, one of which operates in adsorption while the other is being regenerated; a turbine/booster assembly 3 comprising an expansion turbine 4 and a booster 5 whose shafts are coupled; a heat exchanger 6 constituting the heat-exchange line of the plant; a double distillation column 7 comprising a medium-pressure column 8 on which there is a low-pressure column 9, with a vaporizer/condenser 10 setting the head vapour (nitrogen) of the column 8 in heat exchange with the tank liquid (oxygen) from the column 9; a liquid oxygen reservoir 11 whose bottom is connected to a liquid oxygen pump 12; and a liquid nitrogen reservoir 13 whose bottom is connected to a liquid nitrogen pump 14.

This plant is intended to supply oxygen gas at the working pressure P via a user pipe 15.

For this purpose, the liquid oxygen drawn off from the tank of the column 9 via a pipe 16 and stored in the reservoir 11 is brought to the high pressure P1 (30 bar) by the pump 12 in the liquid state, then vaporized and heated at this high pressure in passages 17 in the exchanger 6, under the conditions in FIG. 1(*c*) and sent to the buffer 38. Under the conditions in FIG. 1(*d*) this oxygen is expanded at 40 and sent into the pipe 15 via the pipe 39.

The heat required for this evaporation and heating, as well as for heating and optionally vaporizing other fluids drawn off from the double column, is supplied by the air to be distilled, under the following conditions.

All the air to be distilled is compressed by the compressor 1 to a first high pressure which is significantly greater than the medium pressure of the working column 8. The air, precooled at 18 and cooled to close to ambient temperature at 19, is then purified in one, for example 2A, of the adsorption bottles and boosted in full by the booster 5, which is driven by the turbine 4.

The air is then introduced at the hot end of the exchanger 6 and cooled in full to an intermediate temperature. At this temperature, a fraction of the air continues to be cooled and is liquefied in passages 20 in the exchanger, then is expanded to the low pressure in a pressure-reducer valve 21 and introduced into the column 9 at an intermediate level. The remainder of the air is expanded to the medium pressure in the turbine 4 then sent directly to the base of the column 8 via a pipe 22.

FIG. 3 also shows the usual pipes of double column plants, the one represented being of the "minaret" type, that is to say with production of nitrogen under low pressure: the pipes 23 to 25 for injecting, into the column 9 and at increasing levels, expanded "rich liquid" (air enriched with oxygen), expanded "lower lean liquid" (impure nitrogen) and expanded "upper lean liquid" (substantially pure nitrogen), these three fluids being respectively drawn off at the base, at an intermediate point and at the top of the column 8; and the pipes 26 for drawing off nitrogen gas starting from the top of the column 9 and 27 for removing residual gas (impure nitrogen) starting from the level where the lower lean liquid is injected. The low-pressure nitrogen is heated in passages 28 in the exchanger 6 then removed via a pipe 29, whereas the residual gas, after being heated in passages 30 in the exchanger, is used to regenerate an adsorption bottle, the bottle 2B in the example in question, before being removed by a pipe 31.

FIG. 3 also shows that a part of the medium-pressure liquid nitrogen is stored in the reservoir 13 after it has been expanded in a pressure-reducer valve 32, and that production of liquid nitrogen and/or liquid oxygen is supplied via a pipe 33 (in the case of nitrogen) and/or 34 (in the case of oxygen).

Furthermore, additional liquid oxygen drawn from the reservoir 11 by the pump 36 is vaporized and heated at the working pressure of 16 bar in passages 37, under the conditions in FIG. 1(*b*).

The pressure of the air boosted at 5 is the pressure for condensation of air by heat-exchange with oxygen undergoing vaporization at the working pressure P, that is to say the pressure for which the bend 100 relating to the liquefaction of air, on the heat-exchange diagram, lies slightly to the right of the vertical segment 101 relating to the vaporization of oxygen at the pressure P (FIG. 4). The temperature difference at the hot end of the exchange line is adjusted by means of the turbine 4, the intake temperature of which is indicated at 102.

As regards this high-pressure oxygen flow rate, its vaporization segment 103 (FIG. 4) is shifted to the right with respect to the bend 100 relating to the liquefaction of the boosted air, but in this example remains lower than the temperature of point 102.

During the time interval 0, T, the length of each segment 101, 103 varies, but the sum of the two lengths remains constant.

In comparison with a similar plant having a single pump 12, that is to say such as the one in FIG. 1 of the aforementioned U.S. Pat. No. 5,329,776, an energy gain is obtained, due to the presence of the segment 101 facing the bend 100, all other things being equal. This excess energy can be utilized either by removing extra liquid from the plant, generally liquid nitrogen, or by lowering the compression pressure for the air at 1, while of course keeping the bend 100 to the right of the segment 101. The aforementioned energy gain fluctuates, during the time interval 0, T, with the length of the segment 101.

FIG. 2 schematizes the same plant, representing only:

- the cold box 41 of the plant, which contains its cryogenic parts;
- the two liquid oxygen pumps 12 and 36 which, in practice, are naturally contained in the cold box; and
- the consumer pipe 15, the buffer 38, the line 39 and the pressure-reducer valve 40.

This diagram thus schematizes the fact that the two oxygen production deliveries, respectively at 16 bar and at 30 bar, the sum of whose flow rates is constantly equal to D1, are supplied by the compression/vaporization/heating of the two liquid oxygen flow rates originating from the low-pressure column 9.

As a variant, instead of being connected to the reservoir 11 in parallel, the pumps 12 and 36 may be mounted in series, the intake of the pump 12 being tapped from the delivery pipe of the pump 36.

FIG. 5 represents an alternative plant which differs from the previous one by the omission of the pump 36 and the corresponding vaporization/heating circuit.

All of the flow rate D1 is thus brought by the pump 12 to 16 bar, vaporized, heated and sent into the pipe 15.

Under the conditions in FIG. 1(*c*), oxygen is drawn from the pipe 15 at a point 42, compressed to 30 bar by an oxygen compressor 43 and sent to the buffer 38. The latter is, as before, connected to the pipe 15 by the pipe 39 which is equipped with the valve 40.

In the variant in FIG. 6, the single pump 12 brings the flow rate D1 to 30 bar. A fraction of this flow rate is expanded to 16 bar in a pressure-reducer valve 143 and vaporized, under the conditions in FIG. 1(*b*), and sent to the pipe 15. The remainder of the liquid is vaporized at the high pressure of 30 bar and sent to the buffer 38.

Figure 8:
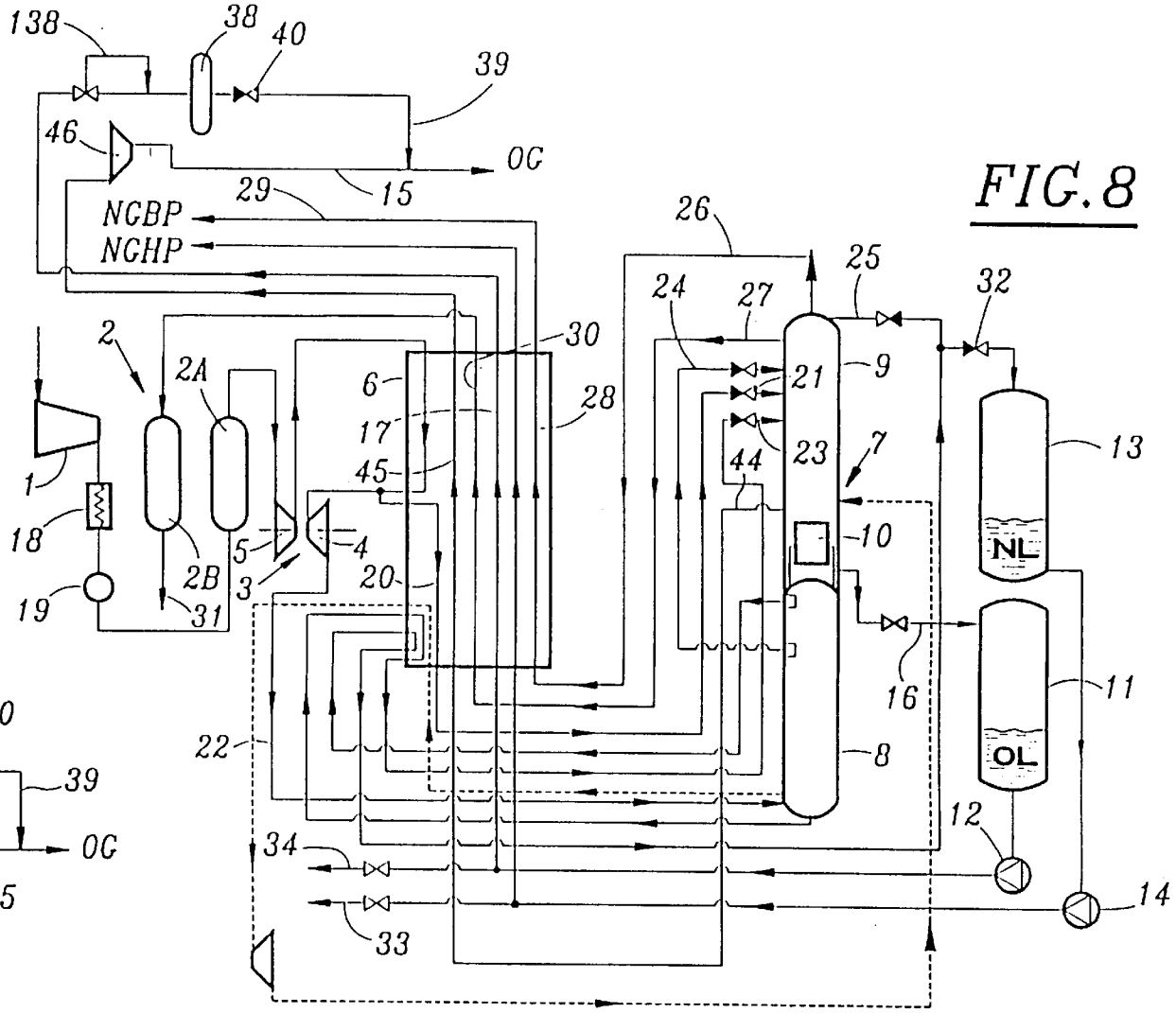
FIG. 8 is a view which is similar to FIG. 3 and corresponds to the plant in FIG. 7.
Figure 7:
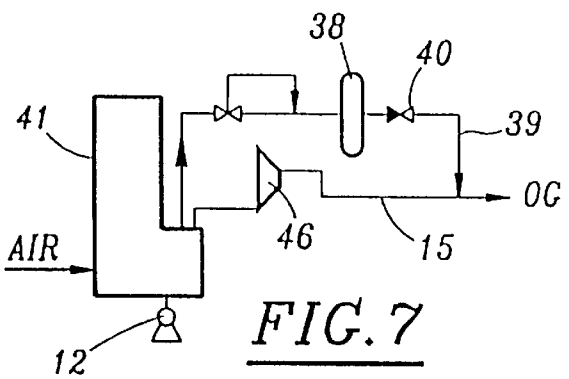
FIG. 7 is a view which is similar to FIG. 2 and represents another variant of the plant.

FIGS. 7 and 8 represent another variant of the plant, which differs from the one in FIGS. 2 and 3 only by the fact that the oxygen at 16 bar is withdrawn in the form of gas from the tank of the low-pressure column 9, by a pipe 44, heated at the low pressure in passages 45 in the exchange line 6, and brought to 16 bar by an oxygen compressor 46. For its part, the oxygen at 30 bar is withdrawn from the reservoir 11 by the pump 12 which brings it to this high pressure in liquid form, then is vaporized and heated in passages 17, and sent directly to the buffer 38.

In the embodiments above, it is possible to add a buffer tank for liquid air in order to damp the variations over time in the flow rate of liquefied air feeding the double column.

Figure 9:
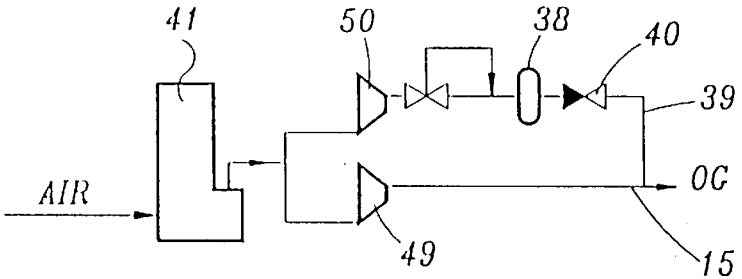
FIGS. 9 and 10, on the one hand, 11 and 12, on the other hand, represent two other embodiments of the plant, in similar fashion to FIGS. 2 and 3, respectively.
Figure 10:
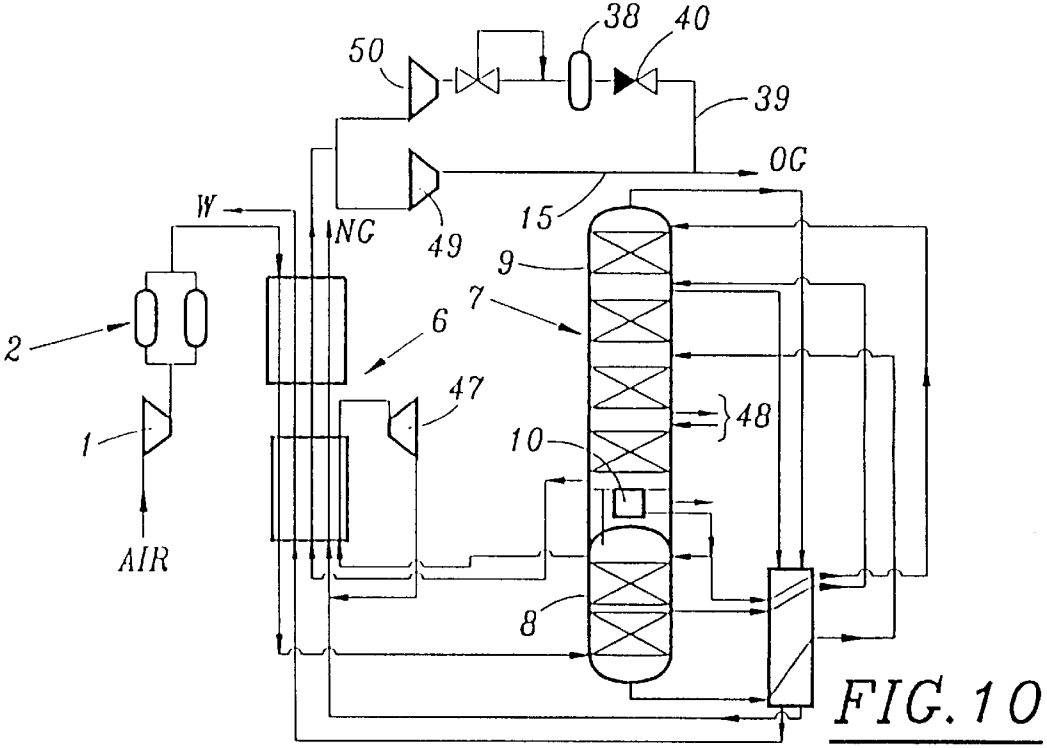

FIGS. 9 and 10 illustrate the implementation of the invention with a conventional pumpless air distillation apparatus, with a nitrogen cycle (turbine 47 expanding medium-pressure nitrogen to the low pressure) and with an argon separation column (not shown) coupled to the low-pressure column by two pipes 48.

In this case, the flow rate of oxygen D1 is withdrawn in the form of gas from the tank of the low-pressure column and, after heating, is compressed to 16 bar and/or 30 bar, under the conditions described above, using two respective oxygen compressors 49 and 50. The compressor 49 delivers directly into the pipe 15, whereas the compressor 50 delivers into the buffer 38.

Figure 11:
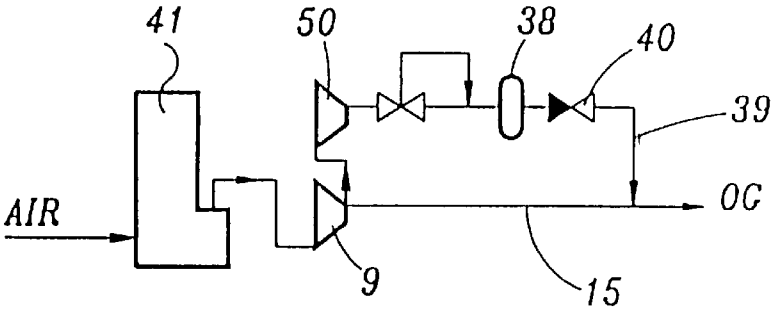
Figure 12:
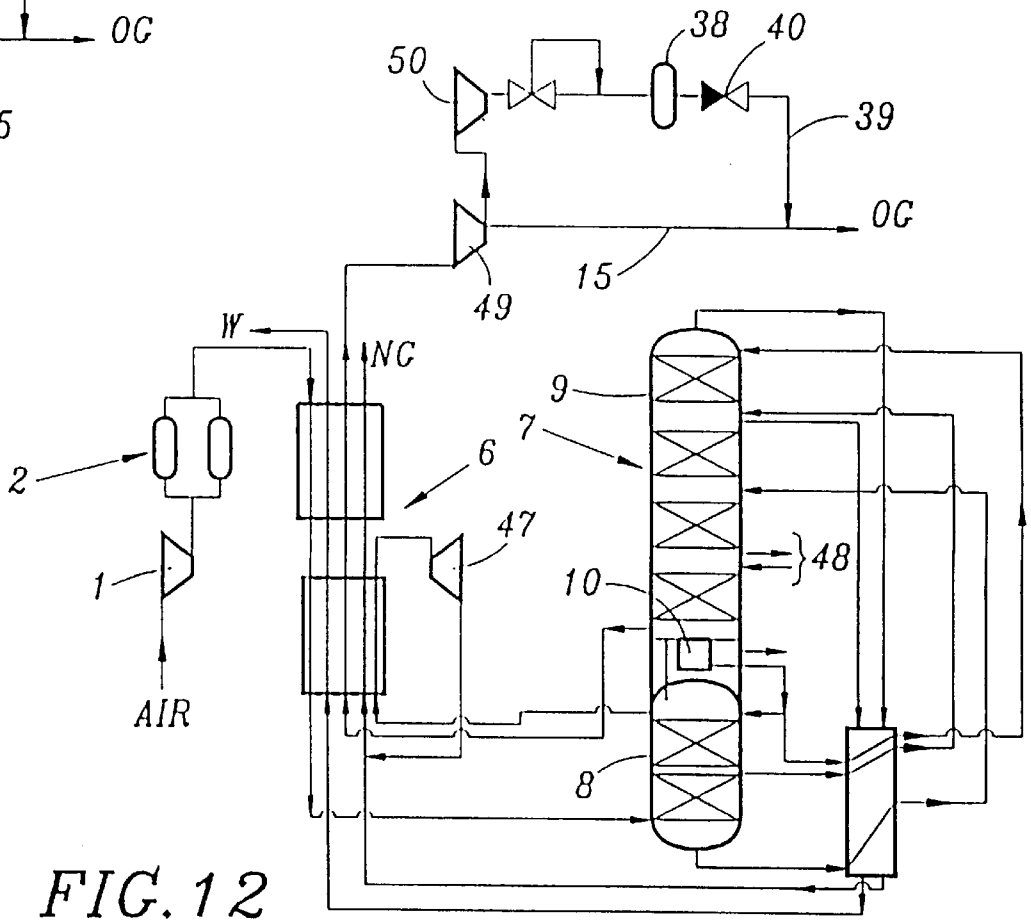

The plant in FIGS. 11 and 12 differs from the previous one only by the fact that the two oxygen compressors are mounted in series instead of being mounted in parallel. Thus, the compressor 49 compresses all of the flow rate D1 to 16 bar, and the compressor 50 brings the flow rate d2 described with reference to FIG. 1(*c*) from 16 to 30 bar.

The compressors 49 and 50 may, of course, consist of two stages, or groups of stages, of the same machine.

Throughout the description above, the term "working pressure" has been used to denote the pressure in the pipe 15. However, this does not rule out a subsequent modification of this pressure, for example by expansion.

Furthermore, in each embodiment of the plant, the pressure controller 138 may be omitted. The pressure in the buffer then varies between the pressures P and P1 over time.

As a further variant, the method according to the invention may use a plurality of buffers at different high pressures P1, P2, etc. which are all significantly higher than the working pressure P. When the demanded flow rate is greater than D1, gas is then drawn from one or other of the buffers, according to the variations in this flow rate.

We claim:

1. Method for supplying a consumer pipe for a time interval with a variable demanded flow rate of a constituent of air produced by an air distillation apparatus, the method comprising:

drawing a total flow rate of the constituent at a constant value from the distillation apparatus;

dividing the time interval into several periods, namely:

at least a first period during which the demanded flow rate is equal to the total flow rate;

at least one second period during which the demanded flow rate is less than the total flow rate; and at least one third period during which the demanded flow rate is greater than the total flow rate;

during the second period:

bringing the demanded flow rate to the working pressure and sending said demanded flow rate to the consumer pipe; and bringing a storage flow rate of the constituent, equal to the difference between the total flow rate and the demanded flow rate to a high pressure greater than the working pressure, and storing said storage flow rate in at least one buffer tank; and during the third period:

bringing the total flow rate to the working pressure and sending the total flow rate to the consumer pipe, and also sending to the consumer pipe a supplementary flow rate of the constituent, equal to the difference between the demanded flow rate and the total flow rate, said supplementary flow rate being drawn from at least one buffer tank and expanded to the working pressure.

2. Method according to claim 1, wherein the total flow rate is drawn in liquid form from the distillation apparatus and is compressed in said liquid form by pumping before being vaporized.

3. Method according to claim 2, wherein a first liquid flow rate is brought to the working pressure by a first pump, the storage flow rate intended for the buffer tank is brought to the high pressure by a second pump, and each liquid flow is vaporized under its pumping pressure.

4. Method according to claim 2, wherein the total flow rate is brought to the working pressure by a single pump, the liquid is vaporized and the fraction of gas thus obtained is brought to the high pressure.

5. Method according to claim 2, wherein the total flow rate is brought to the high pressure by a single pump, a fraction of said total flow rate is expanded to the working pressure, and the two flows are each vaporized under pressure.

6. Method according to claim 1, wherein the first portion of the total flow rate is drawn in liquid form from the distillation apparatus, is compressed by pumping, and is vaporized under pressure; and the remainder of the total flow rate is drawn in the form of gas from the distillation apparatus and is compressed in said gas form.

7. Method according to claim 1, wherein the total flow rate is drawn in the form of gas from the distillation apparatus, a fraction of said gas is compressed to the working pressure, and the storage flow rate intended for the buffer tank is compressed to the high pressure.

8. Method according to claim 7, wherein each flow rate is compressed independently from the withdrawal pressure of the distillation apparatus.

9. Method according to claim 7, wherein the total flow rate is compressed to the working pressure, and a fraction of this flow rate is compressed from the working pressure to the high pressure.

10. Method according to claim 1, wherein the constituent of air is oxygen.

11. Air distillation plant for supplying a consumer pipe with a variable flow rate of a constituent of air produced by an air distillation apparatus, the plant comprising:

means for drawing a constant flow rate of the constituent from the distillation apparatus;

a buffer tank;

first means for bringing at least a part of the total flow rate to a working pressure and in the form of gas, said first means being connected to the consumer pipe;

second means for bringing a second flow rate of the constituent to a high pressure greater than the working pressure and in the form of gas, said second means being connected to the buffer tank; and an auxiliary pipe fitted with a controlled pressure-reducer valve, connecting the buffer tank to the consumer pipe.

12. Plant according to claim 11, wherein the first means comprise a first pump and first vaporization means, and the second means comprise a second pump and second vaporization means.

13. Plant according to claim 11, wherein the first means comprise a pump and vaporization means, and the second means comprise a compressor having an intake connected to an outlet of the vaporization means.

14. Plant according to claim 11, wherein the first means comprise a pump, a pressure reducer valve, and first vaporization means; and the second means comprise second vaporization means connected to a delivery of the pump.

15. Plant according to claim 11, wherein the first means comprise a compressor having an intake connected to a gas withdrawal point of the distillation apparatus, and the second means comprise a pump and vaporization means connected to a delivery of the pump.

16. Plant according to claim 11, wherein the first and second means respectively comprise two compressors having intakes connected in parallel to a withdrawal point of the distillation apparatus.

17. Plant according to claim 11, wherein the first means comprise a first compressor having an intake connected to a gas withdrawal point of the distillation apparatus, and the second means comprise a second compressor having an intake connected to a delivery of the first compressor.

* * * * *